United States Patent [19]

Steinke et al.

[11] 3,935,003

[45] Jan. 27, 1976

[54] PROCESS FOR MELTING METAL

[75] Inventors: Theodore D. Steinke, Pleasanton; Melvin A. Carter, Livermore, both of Calif.

[73] Assignee: Kaiser Aluminum & Chemical Corporation, Oakland, Calif.

[22] Filed: Feb. 25, 1974

[21] Appl. No.: 445,721

[52] U.S. Cl. ..... 75/68 R; 75/65 R; 266/33 S

[51] Int. Cl.[2] ..... C22B 21/00

[58] Field of Search ..... 75/68, 65, 93, 46, 68 R, 75/65 R; 266/33 R, 33 S

[56] References Cited

UNITED STATES PATENTS

| | | | |
|---|---|---|---|
| 2,465,544 | 3/1949 | Marsh | 75/65 |
| 2,528,209 | 10/1950 | Bonsack et al. | 266/33 |
| 3,272,619 | 9/1966 | Sweeney et al. | 75/65 |
| 3,276,758 | 10/1966 | Baker et al. | 266/33 R |
| 3,411,447 | 11/1968 | Fox et al. | 75/65 X |
| 3,417,166 | 12/1968 | Foster | 75/65 X |
| 3,490,896 | 1/1970 | Steinke | 75/65 X |
| 3,539,169 | 11/1970 | Higgs et al. | 266/33 |
| 3,734,719 | 5/1973 | Estes et al. | 75/65 |
| 3,759,635 | 9/1973 | Carter et al. | 75/65 X |
| 3,770,420 | 11/1973 | Spear et al. | 75/65 R |

*Primary Examiner*—M. J. Andrews

*Attorney, Agent, or Firm*—Paul E. Calrow; Edward J. Lynch

[57] ABSTRACT

This invention relates to an improved method of melting metal, particularly reactive metals, such as aluminum, wherein heated molten metal is withdrawn from a first chamber and a portion of the withdrawn molten metal is transferred to a second chamber containing solid metal so as to melt same and a portion of the withdrawn metal is recirculated to the first chamber so as to maintain melt homogenuity therein.

10 Claims, 2 Drawing Figures

PROCESS FOR MELTING METAL

BACKGROUND OF THE INVENTION

This invention relates to an improved furnace system for the melting of reactive metals, and, in particular, the melting of aluminum and aluminum alloys. Conventional practice in the melting of aluminum and aluminum alloys generally comprises placing solid metal to be melted, such as pigs, ingots, heavy scrap and the like, in a fuel-fired furnace containing a heel of molten metal. This melting practice was characterized by a low melt rate and extremely high melt losses due to metal oxidation. After the melting has been completed and alloying constitutuents added, the melt is stirred and then transported to a casting facility or to a holding furnace for subsequent casting. During the initial stages of this conventional practice, the melting rates are quite high due to the direct exposure of the solidified metal to the flame and combustion products, but concomitantly, the metal oxidation rate is quite high. It should be noted that metal lost to oxidation is probably the largest single cost in converting the solid metal to molten metal. When most of the solid metal is below the surface of the molten metal, the melt rate is drastically reduced due to the layer of oxide skim which inherently forms on the molten metal surface and the formation of a slushy aluminum at the solid-liquid metal interface both of which severely lower the heat transfer rate.

The metal products with a high surface-to-weight ratio which characteristically generate much oxide when melted by normal practice, such as thin sheet, foil, chips and the like, are usually melted in separate melting facilities, cast into pigs or sows, then remelted in the method described above.

The suggestion has been made (see, for example, U.S. Pat. No. 3,276,758 - Baker et al) to charge small chips and the like into a separate bay while pumping molten metal from a heating hearth to the separate bay to quickly submerge the chips and the like into the molten metal and melt the solid charge. The molten metal in the charging bay is returned to the heating hearth by gravity. However, one major problem with this system is the lack of a homogeneous melt. The melt in the heating hearth tends to stratify and frequently the cooler molten metal returned to the heating hearth will short circuit to the pump intake port.

Against this background, the present invention was developed.

DESCRIPTION OF THE INVENTION

Figure 1:
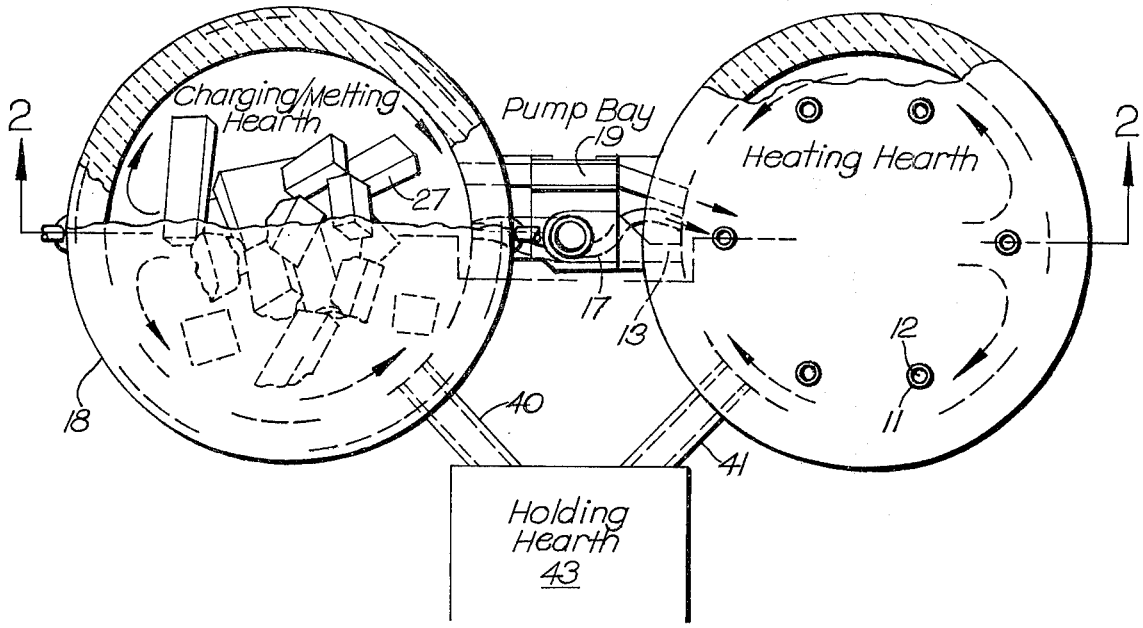
FIGS. 1 and 2 are elevation and plan views in section of a system for practicing the present invention.

This invention is directed to a process for the melting of reactive metal products such as aluminum and the like, which is characterized by substantially increased melt rate and a substantially lowered melt loss in comparison with conventional melting practices. Melt rate increases of up to 30% or more and melt loss reductions of up to 50% or more are found with the present invention. Moreover, the process has a substantially improved flexibility in that large metal pieces, such as pigs, ingot, thick plate and the like, as well as small metal pieces, such as sheet, foil, chips and the like, can be melted by the process, separately or together, with essentially no changes in the process.

In accordance with the present invention, a substantial heel of molten metal is maintained in a first chamber or heating hearth wherein heat is applied to the molten metal by suitable means, such as fuel burners and the like. The solid metal to be melted is placed in a second chamber or charging hearth. Molten metal is withdrawn from the heating hearth and a portion thereof is transferred to the charging hearth so as to melt the solid metal therein. In the process of the present invention, substantially all of the solid metal melting is caused by the contact of moving molten metal. The remaining portion of the withdrawn molten metal is recirculated back to the heating hearth so as to maintain the proper heat and compositional homogenuity within the melt. Molten metal in the charging hearth is returned by suitable means, usually by gravity, to the heating hearth. When melting and mixing are completed, the molten metal can then be transferred to a holding hearth for subsequent casting.

To obtain the improvements with the present invention, substantial quantities of metal must be transferred. Usually, molten metal amounting to at least 2%, preferably at least 10%, of the total metal in the system (both solid and liquid) must be transferred per minute from the heating hearth to the charging hearth. From about 5–50%, preferably about 5–30%, of the total molten metal withdrawn from the heating hearth should be recirculated to the heating hearth for mixing purposes. The temperature differential between the molten metal pumped to the charging hearth and the cooler molten metal returning to the heating hearth is at least 10°F, preferably from about 50°–100°F.

Because no metal is exposed directly to the flame or the combustion products thereof in the heating hearth, the oxide skim on top of the molten metal therein has different characteristics than that normally found in melting furnaces. The skim is much thinner and much denser and, moreover, it has a higher thermal conductivity. Although very little oxide skim is generated in the heating hearth, it is nonetheless preferred to control the thickness of this surface oxide to less than one-half inch, preferably one-tenth inch or less for high heat transfer from the burners to the molten metal thereunder. This is to be compared with conventional melting practices where the dross layer can range from two inches to two feet or more. The skim can be controlled to a certain extent by avoiding direct flame impingement upon the surface of the molten metal in the heating hearth. This minimizes any disturbance of the oxide layer which can accelerate oxide formation. By directing the flame parallel to the surface of the melt a suitable distance therefrom, the oxide surface will remain essentially undisturbed. A particularly suitable burner, Model DSF manufactured and sold by the Eclipse Company, produces a planar, high-area flame which is readily directed parallel to the surface of the molten metal. Another method of controlling the skim thickness is to control the burners to effect an essentially stoichiometric combustion and thereby prevent any excessive amounts of oxygen in the heating hearth which can also accelerate oxide formation.

The heat flux in the heating hearth of the present invention is quite high, but not as high as the heat flux characteristic of the conventional furnaces during the period when there is a direct flame impingement upon the solid metal surface. However, the average heat flux over the entire melting period with the present invention is significantly higher than that of the conventional processes because in the conventional melting practice, once all of the solid metal is beneath the surface of the molten metal (flat bath condition), heat transfer rates are significantly reduced.

Burners can be provided in the charging hearth to control the atmospheric oxygen within the furnace chamber. The burners in the charging hearth can also be utilized for heating purposes when the flat bath condition is reached. Thus, when solid metal is above the level of the molten metal, the burners would be on low fire so as to control the oxygen content in the furnace and possibly to preheat the solid metal. However, when the flat bath condition occurs, the burners are turned on to full fire to accelerate the heating of the metal therein. It is preferred to use in the charging hearth the same techniques of controlling oxide formation that are used in the heating hearth, namely, low oxygen content in the furnace atmosphere, and no direct flame impingement on the solid or molten metal.

To maintain efficient melting, the heat flux to the melt in the heating hearth should be above 15,000 BTU/hr ft$^2$, preferably above 20,000 BTU/hr ft$^2$. Flame temperature will generally be about 3000°F. The flat flame previously described is preferred because the view factor of such a flame is increased considerably over the conventional flames. In the present invention, refractory temperatures can range up to about 2700°–2800°F which is higher than the refractory temperatures (e.g., 2600°F) found in conventional melting furnaces. However, because no charges are placed in the heating hearth and because no crane stirring is necessary therein, substantially improved brick life is found.

Alloying additions can usually be added at any time during the process. However, when alloying metals which are lighter than the melt and subject to air burning, such as magnesium alloying in aluminum melts, it may be desirable to add the alloying material at the beginning of the cycle by placing it beneath the main charge and charging both at once to the charging hearth. The charge keeps the alloy material below the surface of the melt where it can quickly be melted and dispersed within the melt with little loss of the material from oxidation. Metal Generally, the melt depth in the heating hearth will range from about 1 to 4 feet. However, the level of the melt should never be below the inlet or withdrawal ports because much oxide will be generated due to the resulting turbulence. Metal flow in both the heating and charging hearths should be controlled and directed as much as possible to provide bifurcated flow which is described and claimed in U.S. Pat. No. 3,490,896 and which is hereby incorporated by reference. Meral velocity in the charging hearth should exceed 1 foot/-second, preferably more than 5 feet/second.

Because of the high temperatures and corrosive nature of molten metal, particularly molten aluminum and magnesium, the conduits employed to transfer the molten metal must be formed of suitable refractory materials. However, the refractory material, and particularly the joints between conduits and the like, tend to aspirate air during molten metal transfer generating considerable amounts of oxide. To avoid this, the metal transfer should be under sufficient positive pressure to avoid aspiration. A particularly suitable pumping system which avoids this problem is shown and claimed in U.S. Pat. No. 3,759,635 which is assigned to the present assignee and is hereby incorporated by reference.

In melting aluminum and aluminum alloys, generally the melt temperature will range from about 1250° to about 1400°F. Molten aluminum temperatures above 1400°F should be avoided because above this temperature several explosions are more apt to occur if contact is made with water, such as in a wet metal charge. Also, temperatures above this tend to cause rapid oxidation of the molten metal.

Figure 2:
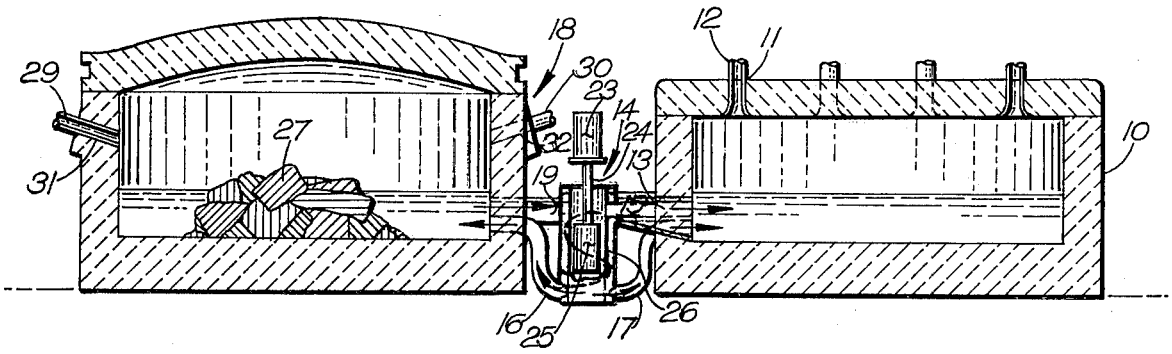

Reference is made to FIGS. 1 and 2 which are respectively elevation and plan views in section of the present invention. The heating hearth 10 is provided with ports 11 in which the burners 12 are positioned for heating the molten metal bath maintained in the chamber. Aperture 13 is provided in the lower portion of the side wall to withdraw molten metal from the heating hearth to the pump 14 by way of trough 15. The outlet from the pump is provided with two conduits 16 and 17, the larger diameter conduit 16 being in fluid communication with the melting hearth 18 and the smaller diameter conduit 17 being in fluid communication with the heating hearth 10. A trough 19 is provided between the heating hearth and the melting hearth for the gravity return of molten metal from the melting hearth to the heating hearth. As shown in the drawings, the discharge from trough 19 and the discharge from conduit 17 are in closed proximity to one another so that the relatively cool molten metal returned from the charging hearth 18 is dispersed by the hotter recirculated metal within the body of molten metal in the heating hearth 10 to prevent the stratification of the cooler metal at the lower portions of the furnace and the short circuiting of the cooler molten metal back into the pump intake 13. The molten metal flow patterns in both the heating hearth 10 and charging hearth 18 are shown by the arrows. The pumping system, which is more thoroughly described in U.S. Pat. No. 3,759,635, generally comprises a pump motor 23, shaft 24 to which is connected a multipole rotor 25 which generates a helically shaped electromagnetic field within the annulus 26 resulting in the downward flow of molten metal through the annulus and out through conduits 16 and 17. A solid charge 27 is shown in the melting hearth 18. The solid metal charge can be introduced by suitable means into the charging hearth through a door (not shown) in the walls of the furnace, or the top of the furnace can be removed and the charge introduced by suitable means. If desired, burners 29 and 30 can be positioned through ports 31 and 32 in the side walls of the melting hearth 18. Troughs 40 and 41 are provided to discharge molten metal to holding hearth 43 when melting and mixing are completed.

The following example is given to illustrate the operation of the present system wherein both the charging hearth and the heating hearth are 20 feet in diameter. At the start of the operations, a molten metal heel of approximately 80,000 pounds of metal is in the system at a temperature of about 1400°F. Total pump flow is 6,000 pounds per minute with 4,200 pounds per minute being pumped to the charging hearth and the remainder recirculated to the heating hearth. Burners in the heating and charging hearths are at minimum fire. At the start of the cycle, approximately 80,000 pounds of solid aluminum are charged to the charging hearth over a 13-minute period. The burners in the heating hearth are immediately advanced to full fire to supply about 24,000,000 BTU per hour into the melt. Burners in the charging hearth are maintained at low fire. At the start of the charging operations, the total pump output is increased to 20,000 pounds per minute with approximately 14,000 pounds per minute being transferred to the charging hearth and 6,000 per minute to the heating hearth. After about 20 minutes, the solid charge is approximately one-third melted and the molten metal in the heating hearth is approaching its minimum super heat of approximately 50°F, i.e., a temperature of about 1255°F. After approximately one hour, the solid charge is approximately ⅔ melted with the charging hearth approaching a flat bath condition. With this, the burners in the charging hearth are advanced to full fire to accelerate the heating in the charging hearth. After approximately 85 minutes, the metallic charge is completely melted and the system contains approximately 160,000 pounds of molten metal at a temperature of about 1255°F in the heating hearth and approximately 1210°F in the charging hearth. After about an hour and one-half, the metal approaches the desired temperature of about 1300°–1350°F and all burners in both hearths are reduced to a minimum fire. Approximately 80,000 pounds of molten metal is then transferred to a holding hearth. The temperature of the molten metal heel remaining in the system is heated to a temperature of about 1400°F and the system is ready for the next charge. Sampling and alloy corrections are made in the holding hearth, if needed. The time from the start of the operations to this point is approximately two hours and the system is ready for the next charge. Net melt loss in the above example is estimated at about 1% or less of the metal melted, whereas net melt losses in conventional melting furnaces can exceed 1.5%. Melting rates in the above example are about 150 pounds/hr $ft^2$ of hearth area. A typical melting rate in conventional gas-fired furnaces would be about 60 pounds/hr $ft^2$ of hearth area.

Although the process of the present invention has been described in terms of melting aluminum or aluminum alloys, the process is useful for many metals. Moreover, it is obvious that various modifications and improvements can be made to the present invention without departing from the spirit of the invention and the scope of the appended claims.

What is claimed is:

1. A method of melting metal comprising a. maintaining a body of molten metal in a heating chamber;

b. withdrawing molten metal from said heating chamber;

c. pumping a portion of said withdrawn molten metal to a melting chamber containing solid metal so as to melt said solid metal;

d. pumping a portion of said withdrawn molten metal to said heating chamber so as to maintain a substantially homogeneous melt in said heating chamber; and e. returning molten metal from said melting chamber to said heating chamber.

2. The method of claim 1 wherein said metal is aluminum.

3. The method of claim 1 wherein the temperature differential between the molten metal withdrawn from said heating chamber and the molten metal returned from said melting chamber to said heating chamber is at least 10°F.

4. The method of claim 3 wherein the temperature differential is between about 50° and about 100°F.

5. The method of claim 1 wherein the amount of molten metal pumped to said melting chamber per minute is at least 2% of the total metal, both solid and liquid, in the heating and melting chambers.

6. The method of claim 1 wherein the amount of molten metal transferred to said melting chamber per minute is at least 10% of the total metal, both solid and liquid, in the heating and melting chambers.

7. The method of claim 1 wherein the amount of molten metal recirculated to said heating chamber is about 5–50% of the total molten metal withdrawn from said heating chamber.

8. The method of claim 1 wherein the amount of molten metal recirculated to said heating chamber is about 5–30% of the total molten metal withdrawn from said heating chamber.

9. The method of claim 1 wherein the oxide on the surface of the molten metal in said heating chamber is controlled to a thickness of less than ½ inch.

10. The method of claim 1 wherein the oxide on the surface of the molten metal in said heating chamber is controlled to less than 1/10 th inch.

* * * * *